US007600275B2

(12) United States Patent
Al-Sabah

(10) Patent No.: US 7,600,275 B2
(45) Date of Patent: Oct. 13, 2009

(54) PORTABLE FURNITURE COMBINATION AND CARRIER

(76) Inventor: Sabah Naser Al-Sabah, P.O. Box 7000, Kuwait City (KW)

( * ) Notice: Subject to any disclaimer, the term of this patent is extended or adjusted under 35 U.S.C. 154(b) by 0 days.

(21) Appl. No.: 11/428,608

(22) Filed: Jul. 5, 2006

(65) Prior Publication Data

US 2007/0044233 A1 Mar. 1, 2007

Related U.S. Application Data

(60) Provisional application No. 60/697,340, filed on Jul. 7, 2005.

(51) Int. Cl.
*A47C 17/62* (2006.01)

(52) U.S. Cl. ..... 5/7; 5/6; 5/417

(58) Field of Classification Search ..... 5/413 R, 5/417–420, 2.1, 6–7
See application file for complete search history.

(56) References Cited

U.S. PATENT DOCUMENTS 4,192,030 A * 3/1980 Casson ..... 5/420
5,085,212 A * 2/1992 DeCosta ..... 607/95

* cited by examiner

*Primary Examiner*—Fredrick Conley
(74) *Attorney, Agent, or Firm*—Allen Dyer Doppelt Milbrath & Gilchrist

(57) ABSTRACT

A portable furniture combination and carrier comprising a shell having a back wall, a bottom, a first fixed side and a second fixed side, and a flexible base having a first wing detachably connectable to the first fixed side and hingedly connectable to the base and capable of standing perpendicular to the base. A second wing is detachably connectable to the second fixed side, and hingedly connectable to the base and capable of standing vertically, and an elongated bottom wing hingedly connected to the base at its end opposite the back wall, the bottom wing foldable to create a foot box and a top cover attachably connectable to the wings to form a box for holding a mattress. Alternatively, the combination comprises a chair having a footrest formed by folding the base, and a backrest formed by folding a top flap upwards from the interior of the shell.

7 Claims, 12 Drawing Sheets

PORTABLE FURNITURE COMBINATION AND CARRIER

RELATED APPLICATION

This application claims priority from provisional application Ser. No. 60/697,340, which was filed on Jul. 7, 2005, and which is incorporated herein by reference in its entirety.

FIELD OF THE INVENTION

This invention relates to a convertible furniture unit that can be used as a bed, a chair or folded for storage and, more specifically, to a portable furniture combination and integral carrier comprising a plurality of cushions, and a shell with handles for ease of carrying the unit. The storage shell unfolds to create a back, a bottom, three fixed sidewalls, and a flexible base that can be unfolded to create a mattress, or a camping bed configuration that shelters a user from the elements in a box structure that surrounds the user, any bed linens he or she wishes to use, and the plurality of cushions disposed in an end-to-end arrangement. For outdoor use, the camping bed configuration may have an optional face cover, such as a mosquito netting or a thermal screen that can be added across a remaining opening in the box to prevent entry therein, thus creating a self-sufficient shelter. Alternatively, the unit can be folded to create a comfortable, portable chair, which can be used as an additional chair for guests, for camping or for any other occasion requiring additional seating.

BACKGROUND OF THE INVENTION

In the past, providing these sleeping accommodations whether to additional guests or on outdoor camping excursions has meant having an additional bed on hand or accommodating visitors on uncomfortable sofa beds, sleeping bags, cots, air mattresses or a combination of these. When camping, persons often use these same cots or air mattresses to prevent themselves from having to lie on the ground in a conventional sleeping bag. These options have the disadvantage of being uncomfortable when used for long periods of time or by persons who are not physically fit or have problems with stiffness when exposed to changes in temperature. Moreover, additional seating in camping situations has meant that separate pieces of furniture for bedding and for seating have to be carried to the campsite and stowed.

The concept of portable furniture, particularly portable beds and chairs, is known in the industry. In U.S. Pat. No. 4,518,203, White teaches the use of four substantially parallelepiped cushions, disposed end-to-end to create a mattress. The mattress is convertible to a sort of chaise by the attachment of straps to orient one of the cushions to provide back support. The entire unit is foldable and can by held together with straps for storage.

The addition of a tote bag is also known. For example, U.S. Pat. No. 4,984,906 to Little describes a multi-purpose utility tote. The tote can be used for storage when closed or opened to provide a t-shaped pad suitable for changing a baby's diaper. Legrendre in U.S. Pat. No. 5,611,625 also describes a multiple part, multipurpose bag that can be converted into a rudimentary chair or mattress.

SUMMARY OF THE INVENTION

The present invention advantageously improves upon the field by comprising a self-contained, light-weight, waterproof bed comprising a plurality of cushions foldable to create a mattress, which provides both body support and insulation from ground dampness, and a storage shell with handles for ease of carrying the folded bed. The storage shell unfolds to create a bottom, a back, two opposed fixed sidewalls and a flexible base, which can be unfolded and attached together to create a box to surround the mattress and a user. An optional face cover, such as mosquito netting can be added across an opening across a user's face to prevent the entry of pests into the bed unit when it is used outdoors. When completely folded, there is enough space remaining in the shell to store a pillow and blanket.

Alternatively, the unit can be folded to create a comfortable, portable chair, which can be used as an additional seat for guests, seating outdoors for camping or outdoor concerts, or any other occasion requiring additional seating.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION

The present invention will now be described more fully hereinafter, in which description preferred embodiments of the invention are discussed. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

General Overview

In operation, the apparatus is used as follows. A top panel and a front panel of the shell may be unattached from two opposed fixed sidewalls and the back wall of the shell. Inside the shell is any optionally stored bed linen and a plurality of cushions arranged in a stack. The top and front panels are folded down comprising a flexible base that is unfolded to a first extended length. The base is again unfolded to the full length of a mattress.

Two side wings lying on the top of the unfolded shell are then raised so that they stand essentially perpendicular to the plane of the base. Any bed linen, such as pillows or blankets, that may have been stored in the case for transport, is removed. A mattress, which is made from the unfolded cushions disposed in an end-to-end arrangement, may then be laid on the base. The remaining portion of the shell is folded over the top of the mattress and attached to the sidewalls using a zipper, Velcro™ or any other conventional means. An enclosing panel, such as a mosquito netting or thermal shield, may be added to the opening at the top of the enclosure to prevent pests from entering the bed when in use or to provide shelter and thermal protection.

Alternatively, the folded cushions may be left in the main portion of the shell and the base twice folded to form a footrest. A top flap taken from the interior of the shell may be set on top of the folded mattress to create a backrest and provide support when the unit is used as a chair.

Structural Detail

Figure 1:
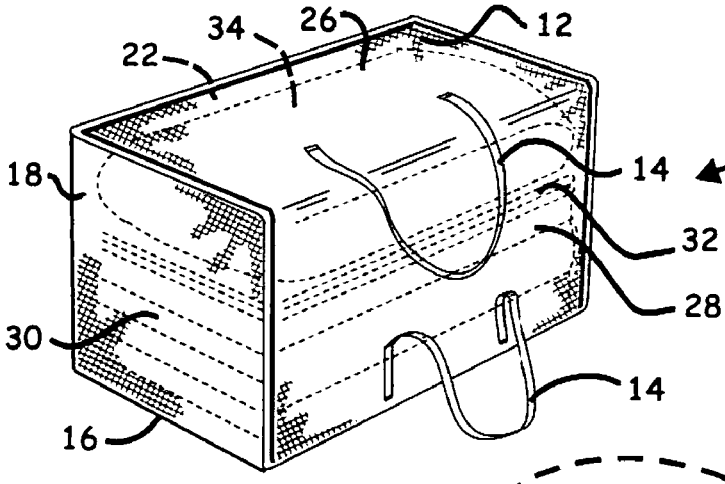
FIG. 1 is a view of a portable furniture shell in its stowed configuration showing a shell with a pair of handles for carrying, a plurality of folded cushions, a blanket and a pillow stowed in their folded conditions.

As illustrated in FIG. 1, the invention comprises a portable furniture combination that may be used as either a bed or a chair and an integral carrier 10, which in a stowed configuration 10 appears as a shell 12 with a pair of handles 14. The shell should be made of a wind-proof, water resistant material if intended for outdoor applications. Use of a treatment, such as a durable water repellant, may be used to prevent improve insulation and water resistance. By way of non-limiting examples, typical shell materials may include: nylon, polyester, microfiber, Dryloft and Gore-Tex. The shell has a bottom 16, two opposed sidewalls affixed to opposed side edges at of the bottom at their bottom edges 18, 20, and a back wall 22 affixed at opposite side edges to respective side edges of the sidewalls and at a bottom edge to a back edge of the bottom 16, and further having a top flap or awning 24, flexibly affixed at a back edge to a top edge of the back wall 22, and removably affixable at opposed side edges to corresponding top edges of the sidewalls 18, 20 to cover at least a portion of the open top. An openable top panel 26 and an openable front panel 28 comprise the remaining faces of the shell 12. The top 26 and front 28 are hingedly connected to one another so that the shell 12 may be opened and used to create the furniture configurations, namely, the bed configuration, the camping bed configuration, and the chair configuration. Inside the shell 12, a plurality of folded cushions 30 is stowed. The plurality of cushions 30 may be made of natural down, cotton, wool, or made-made synthetic fill materials. By way of non-limiting examples, these synthetic fill materials may include: Polarguard 3D™, Primaloft Sport™, Thermolite Extreme™, Quallofil™, Lite Loft™, Dacron 88, Holofil II™, DuPont Fiberfill II™, Permaloft™, Microloft™, Acryloft™, and DN500, as well as others known in the art. The loft of the cushions will depend on the application involved, but should be of sufficient depth to assure the comfort of the user. Sufficient room is available so that a folded blanket 32 and a pillow 34 may also be placed on top of the plurality of cushions 30 arranged in a stack and stored for later use.

Figure 2:
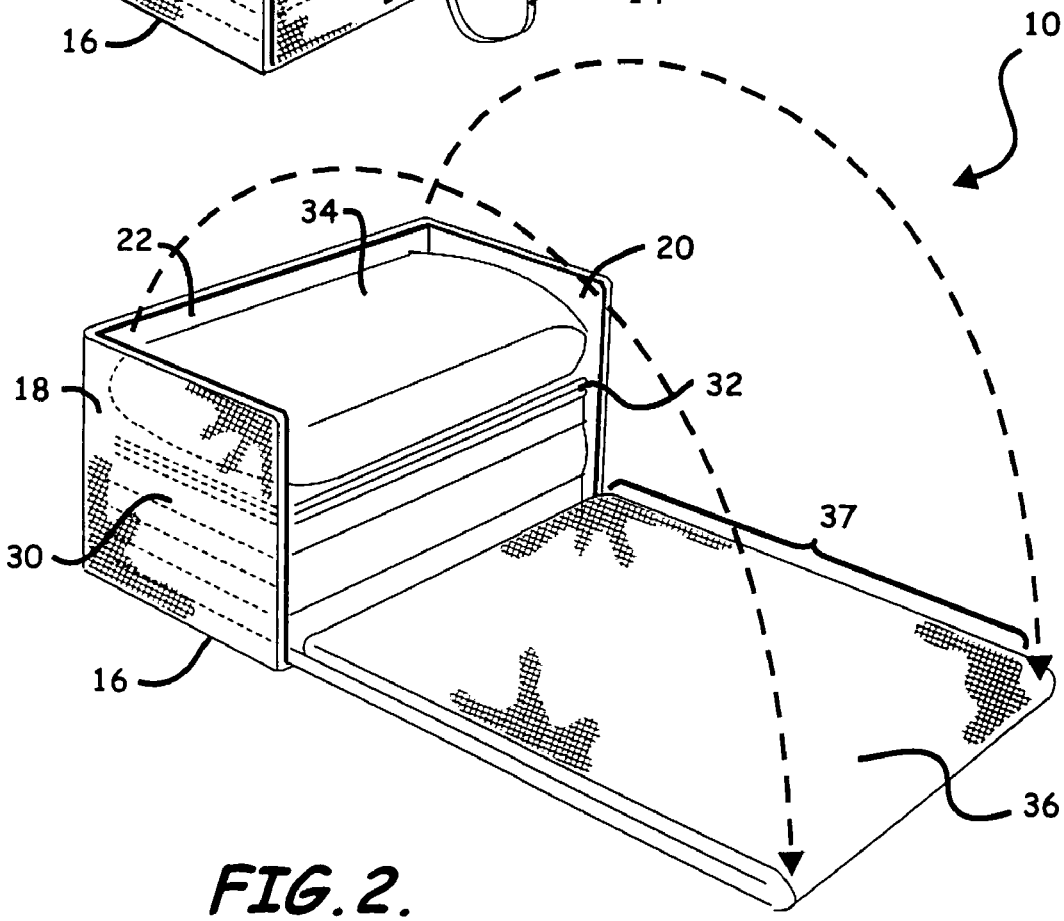
FIG. 2 is a view of the shell being opened and unfolded after a top and front side of the shell are unfastened and folded down to create a base that aligns with the with a bottom of the shell, the base having a first extended length at least as great as twice the height of the fixed sidewalls.

FIG. 2 shows a view of the shell being opened and unfolded after the top 26 and front 28 panels are unfastened and folded down to create a flexible base 36 affixed to the shell bottom 16 at its front edge, the base 36 having a pair of side wings 38, 40 each flexibly affixed at a bottom edge to respective side edges of the base 36 and removably affixable at rear edge to a corresponding fixed sidewall 18, 20 for maintaining upward extension of the wings 38 so that they are able to stand essentially perpendicular to the base 36.

Figure 3:
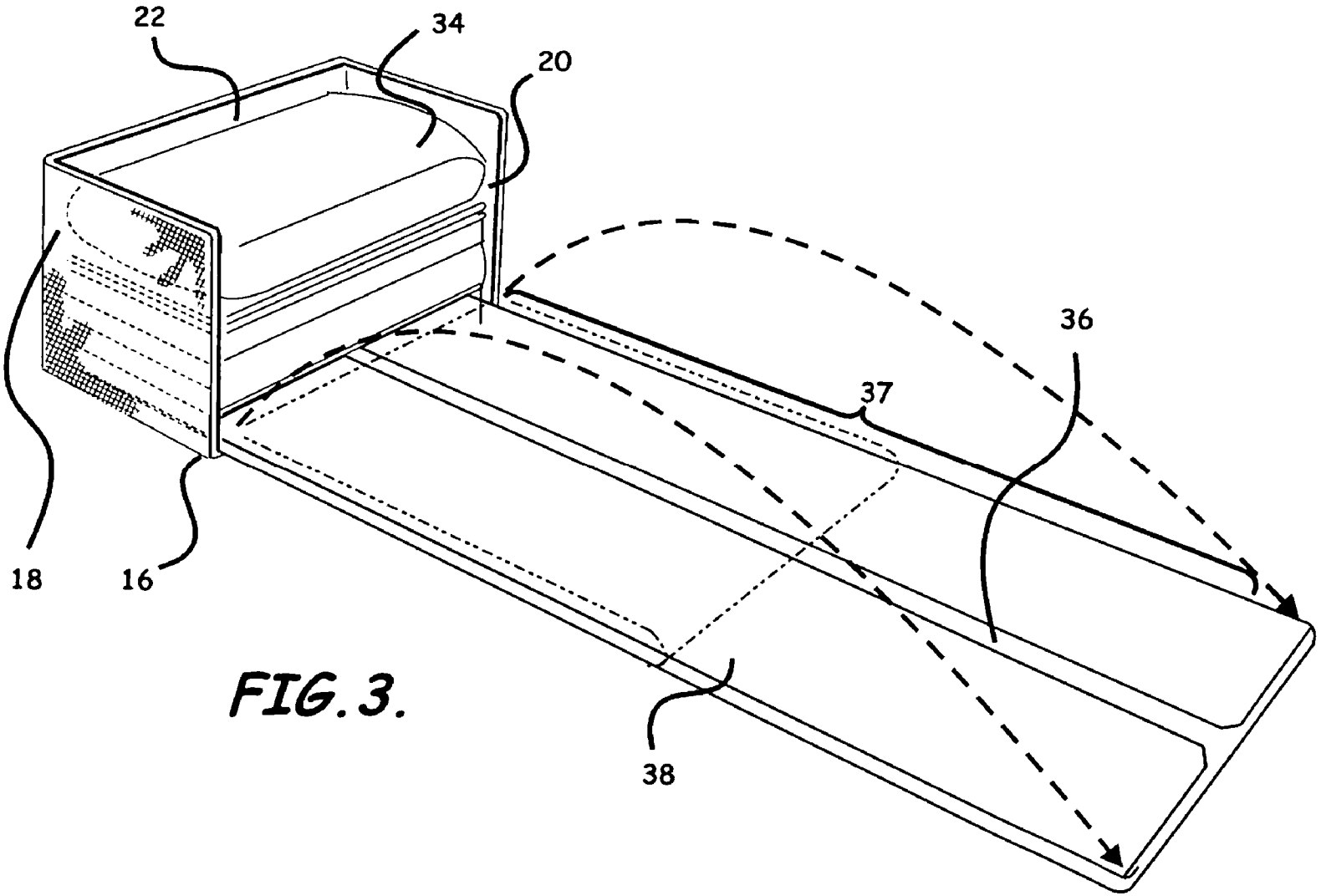
FIG. 3 shows the opened base being unfolded from its first extended length to the full length of the plurality of cushions as they are disposed end-to-end to create a mattress.

The base 36 extends forward of the shell bottom 16 and has a first extended length 37 at least as great as twice the height of the fixed sidewalls 18, 20. FIG. 3 shows the opened base 36 being unfolded a second time to the full length of the plurality of cushions 30 as they are disposed end-to-end to create a mattress 42.

Figure 4:
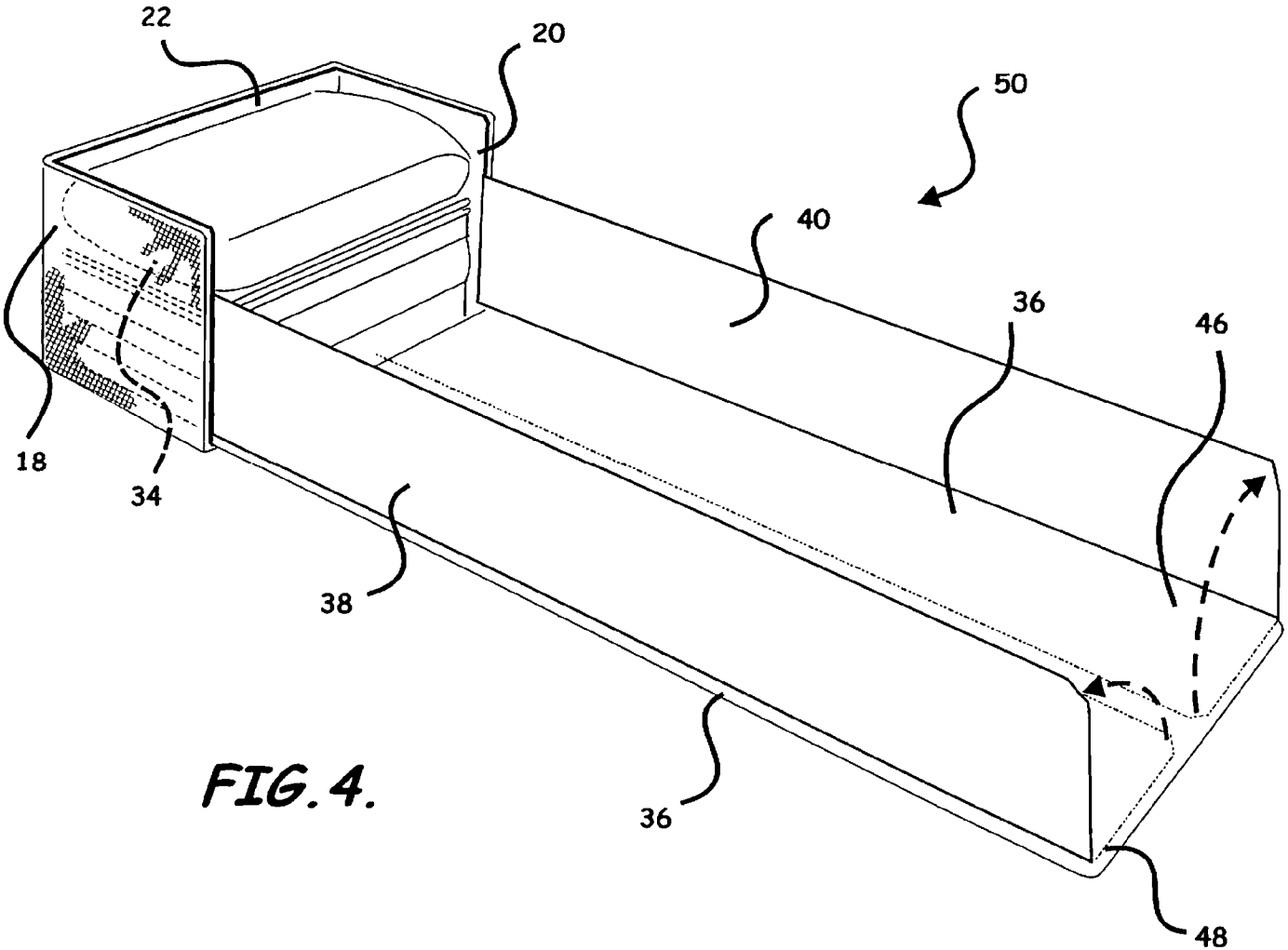
FIG. 4 is a view of a first side wing and a second side wing being raised so that they stand perpendicular to the base, the first side wing is then attached to the first fixed sidewall of the shell, and the second side wing is then attached to the second fixed sidewall of the shell.

In the bed configuration 50, the base 36 extends forward of the shell 12, the side wings 38, 40 extend upwardly, each of the side wings rear edges affixed to the respective shell sidewalls 18, 20, and the top side or awning edges are affixed to the corresponding top edges of the sidewalls. As depicted in FIG. 4, a first side wing 38 and a second side wing 40 are raised from an interior of the unfolded base 36 so that they stand perpendicular to the base. The first side wing 38 is then attached to the first fixed sidewall 18 of the shell 12, and the second side wing 40 is then attached to the second fixed sidewall 20 of the shell. Fixing each of the side wings 38, 40 to its respective sidewall 18, 20 provides added stability. The attachment means will include zippers; Velcro™ or any other conventional means may used to attach the wings to the sidewalls. Those skilled in the art will recognize that in low temperature applications, a zipper draft tube that runs the entire length of the attachment may be necessary to prevent unnecessary heat loss.

Figure 5:
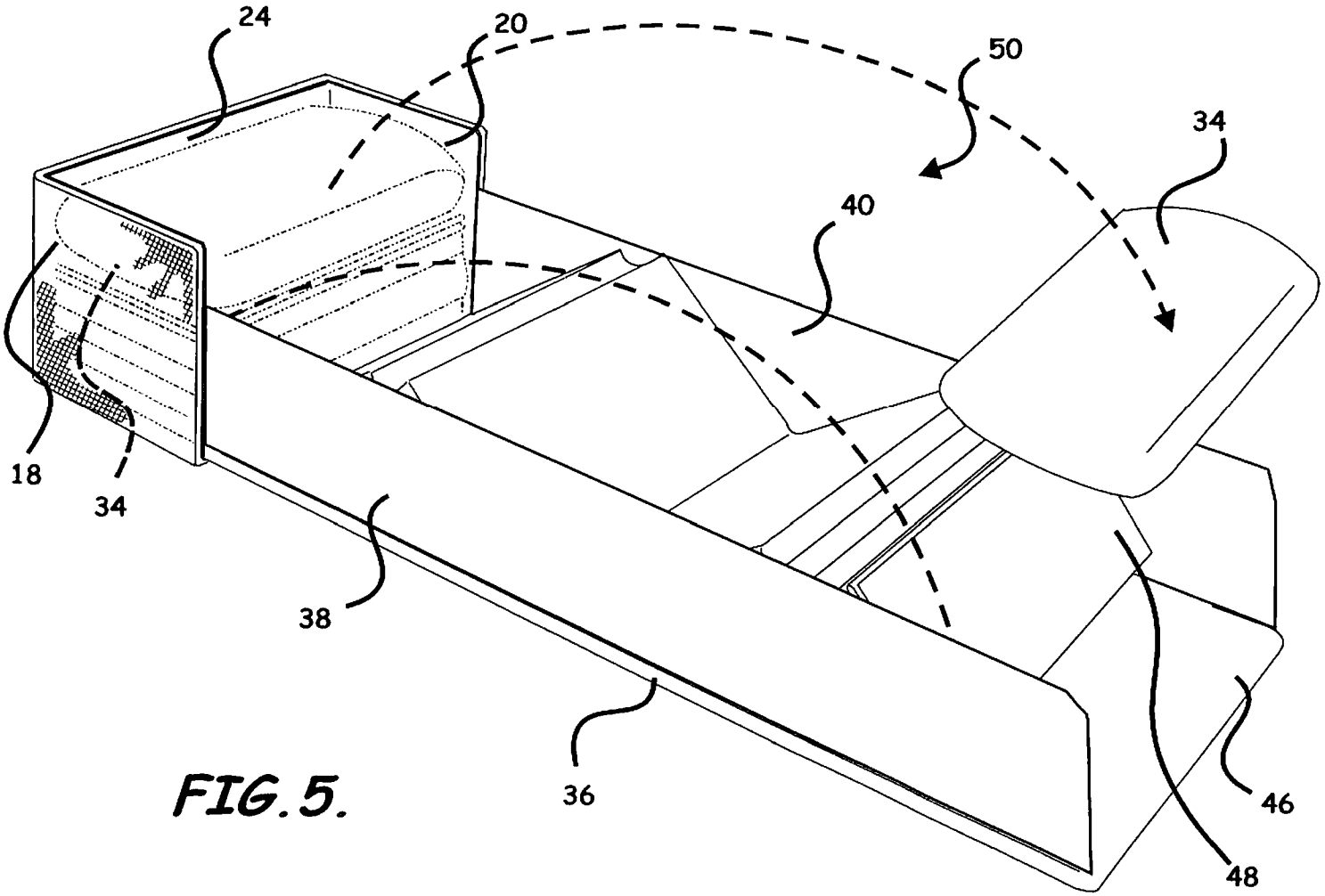
FIG. 5 shows a blanket and pillow stored in the shell being stacked at the foot of the base and a plurality of cushions being unstacked and unfolded to form a mattress.

FIG. 5 shows an optional blanket 32 and a pillow 34 stored in the shell 12 being stacked at the foot 44 of the base and a plurality of cushions 30 being unstacked, unfolded and laid end-to-end to form a mattress 42. This completes the bed configuration 50 and is fully serviceable for use indoors.

Figure 6:
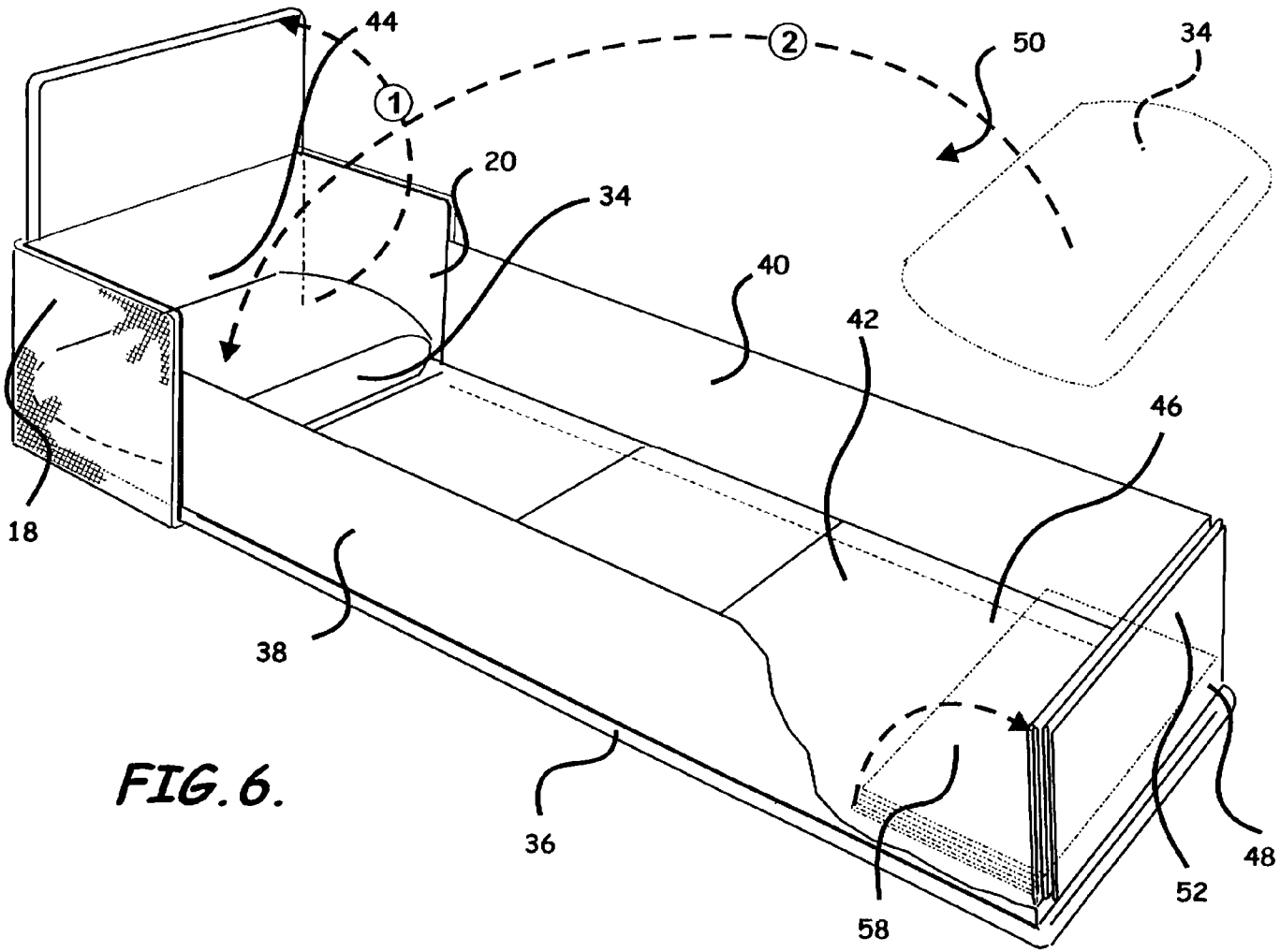
FIG. 6 illustrates that once the mattress is put into place an awning can be unfolded from the interior of the back of the shell, so that a pillow can be laid on top of the mattress inside the space defined by the back and two opposed fixed sidewalls of the shell.
Figure 7:
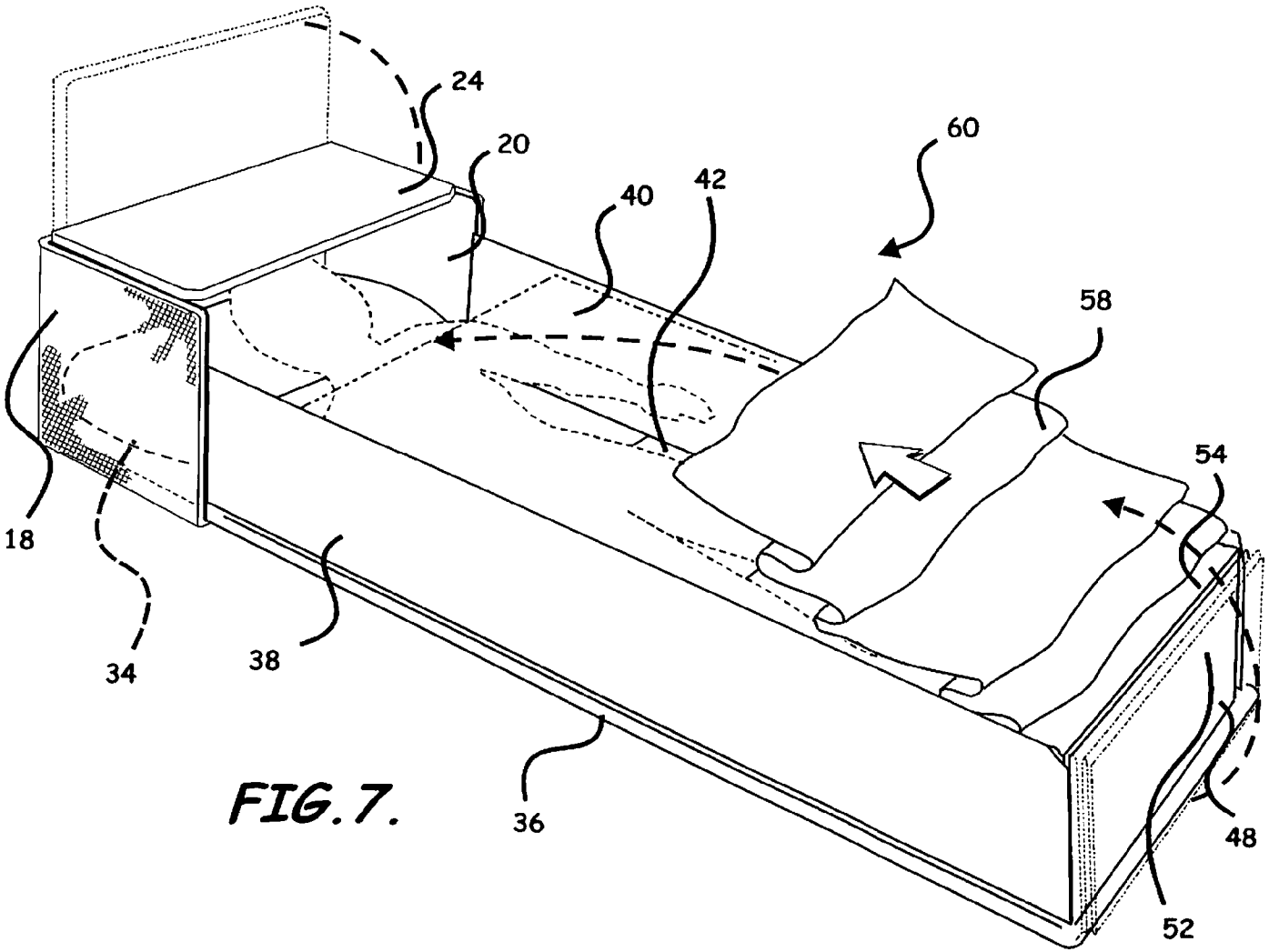
FIG. 7 depicts the awning being folded down and attached to the two opposed fixed sidewalls and creating a shelter for a person's head, a top cover is then brought back over the mattress and attached to the side wings, creating a box that holds the mattress and provides shelter to the user.
Figure 8:
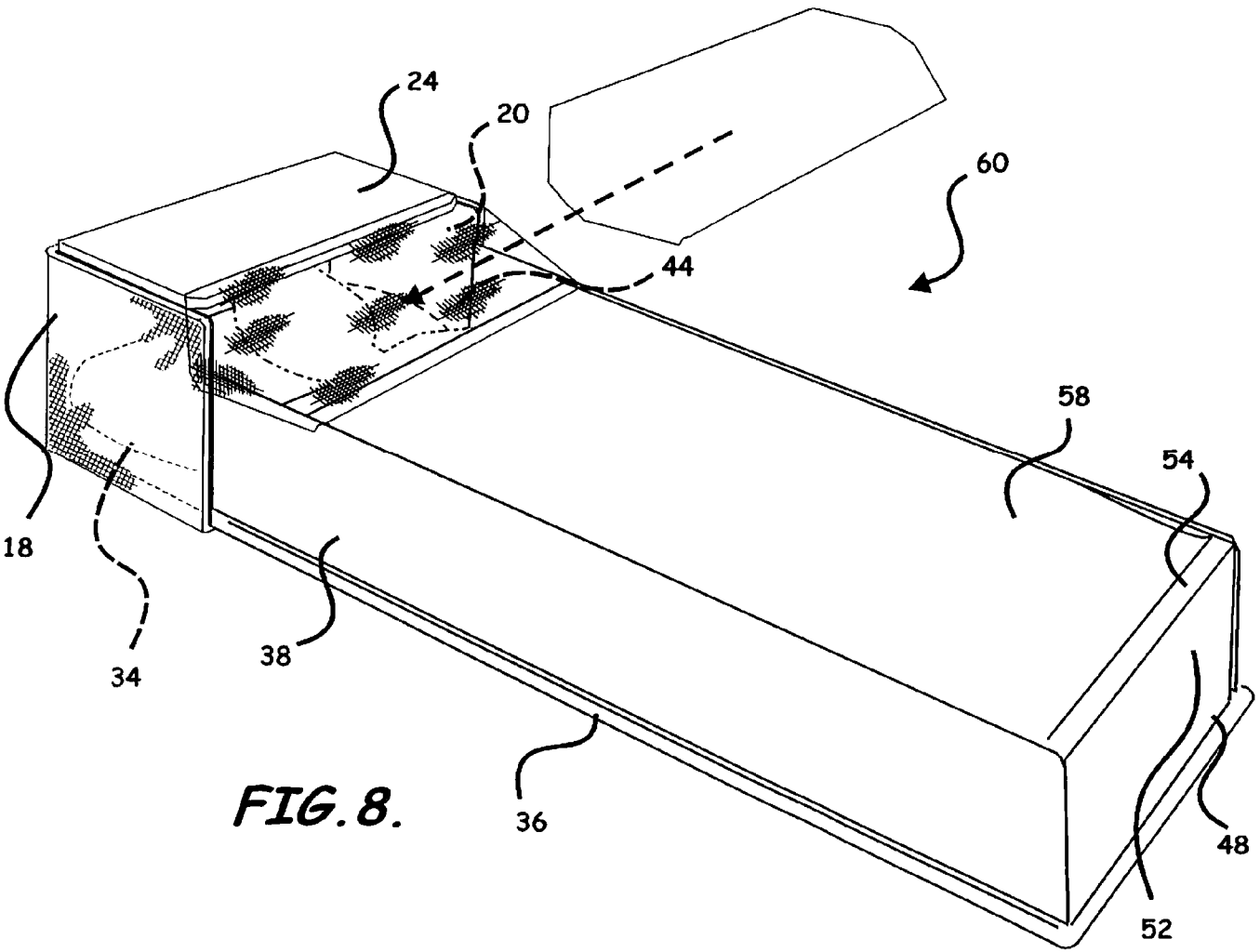
FIG. 8 shows that an optional face cover may be made from mosquito netting to prevent the entry of insects or small animals into the box.
Figure 9:
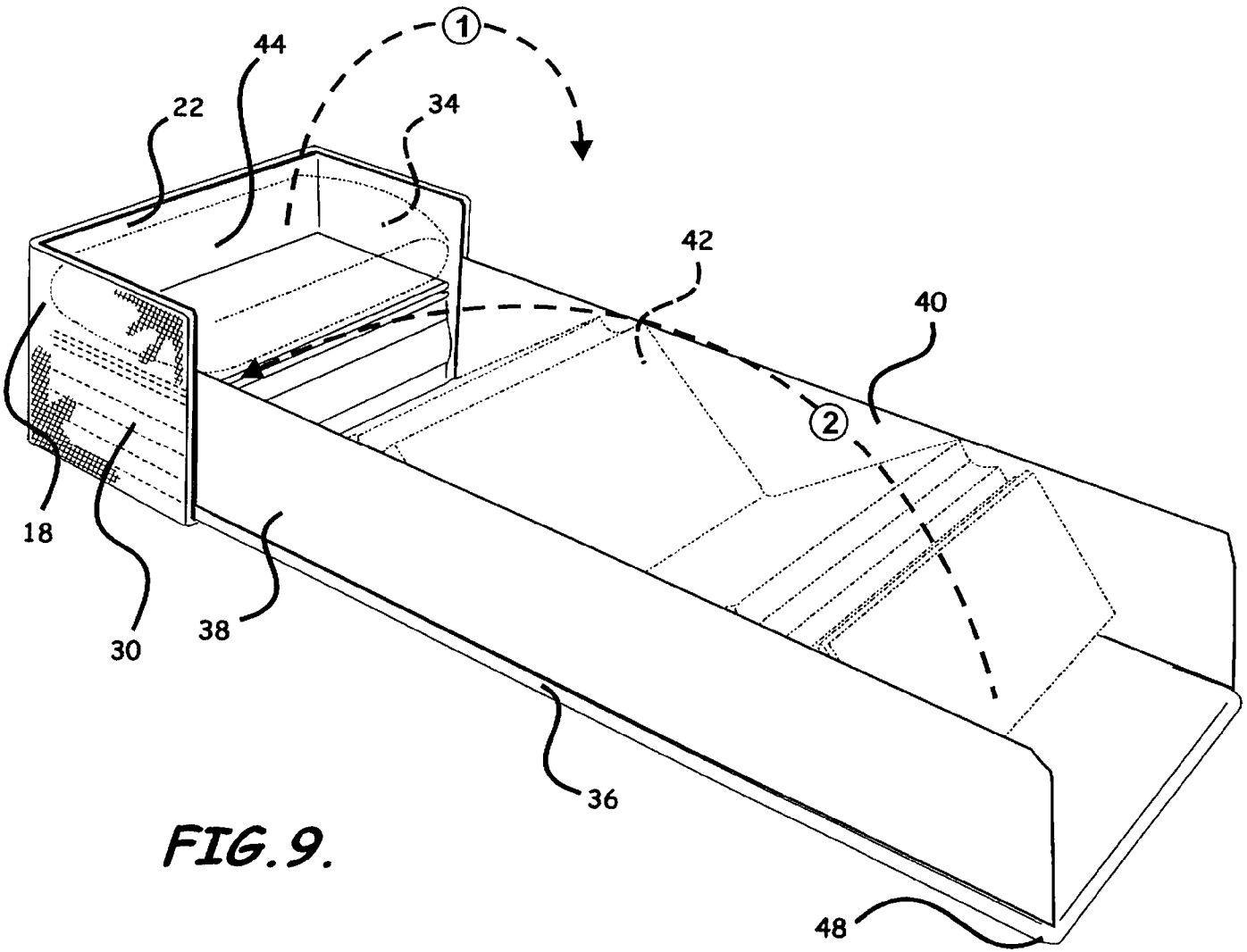
FIG. 9 illustrates that the mattress may be refolded after use and stored inside the space defined by the original shell, or may be removed, as shown, to form the chair configuration.

However, for use outdoors, particularly without the benefit of a shelter, a camping bed configuration 60 may be preferable. FIG. 6 shows that once the mattress 42 is put into place, an awning 24 can be unfolded from the interior of the shell 44, so that a pillow 34 can be laid on top of the mattress inside the space defined by the back wall 22 and the two opposed fixed sidewalls of the shell 18, 20. The awning 24 is folded down and attached to the two opposed fixed sidewalls along their top edges 18, 20 to create a shelter for a person's head, as shown in FIG. 7. A bottom wing 46 connected at the foot of the base 48 is raised perpendicular to plane of the base 36 so that a first portion 52 creates a back wall of a foot box 54. Because the feet are extremely vulnerable to changes in thermal conditions, additional thermal insulation can be added to the first portion 52 of the bottom wing 46, or to the base 36 itself. An optional structural frame 56 for a foot box 54 may be added at the point of connection between the first portion 52 and the base 36. The structural frame 56 should assure a natural position for the user's feet, and allow for the feet to project at right angles to the legs. The structural frame 56 may be made of bone, metal, resin, a plastic or other material appropriate to the application. A remainder of the bottom wing 46, referred to hereafter as a top cover 58, is then folded back over the mattress 42, and attached to the side wings 38, 40 along their forward, vertical standing edges at the foot of the base 48 and along their top edges to create a box 62 that encloses the user. Those skilled in the art will recognize that the base 36, wings 38, 40, the first portion 52 and the top cover 56 are preferably made of materials that are both lightweight and thermally appropriate for the application, season, and geographic location in which the camping bed 60 will be used. As depicted in FIG. 7, the box 62 holds the mattress 42, the user and any bed linen that the user desires and provides shelter to the user. FIG. 8 shows that an optional face cover 62 may be made from a mesh, net, or mosquito netting to prevent the entry of insects or small animals. A thermally insulating mesh material may be used as appropriate for the climate in which use is contemplated.

Figure 13:
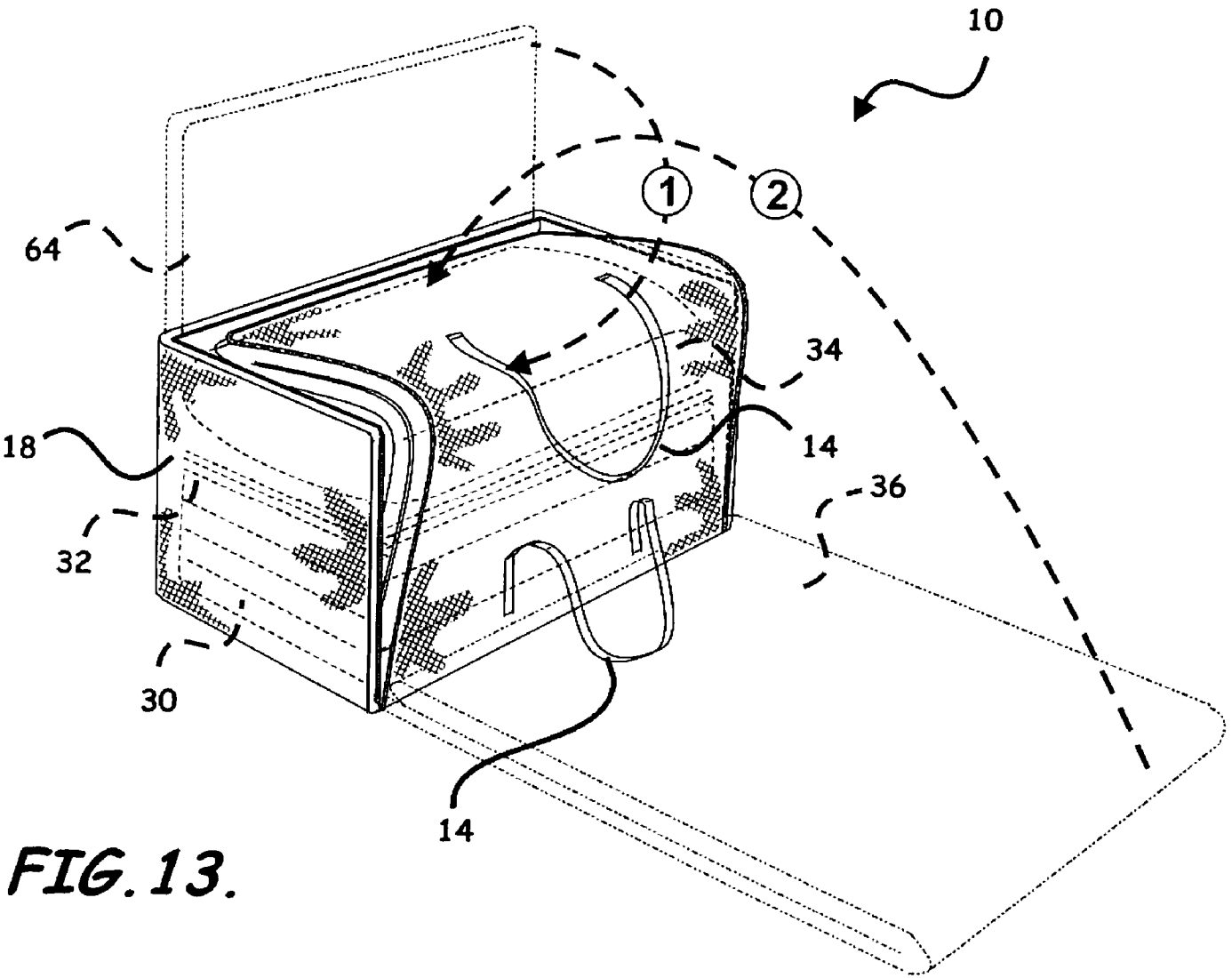
FIG. 13 shows that a pillow and blanket may optionally be stored on top of the mattress in the stowed configuration, the awning is folded down on top of the stack, and then the half-folded base is folded over the awning, and attached along a first side, the top of the back side and a second side to form the front and top of the shell.

After use, the plurality of cushions 30 may be refolded into a stack, and stored inside the space defined by the bottom 16, the two opposed fixed sides 18, 20 and the back wall 22 of the shell, or the cushions may be refolded, as shown in FIG. 13, to form the chair configuration 70.

An Alternate Configuration

Figure 10:
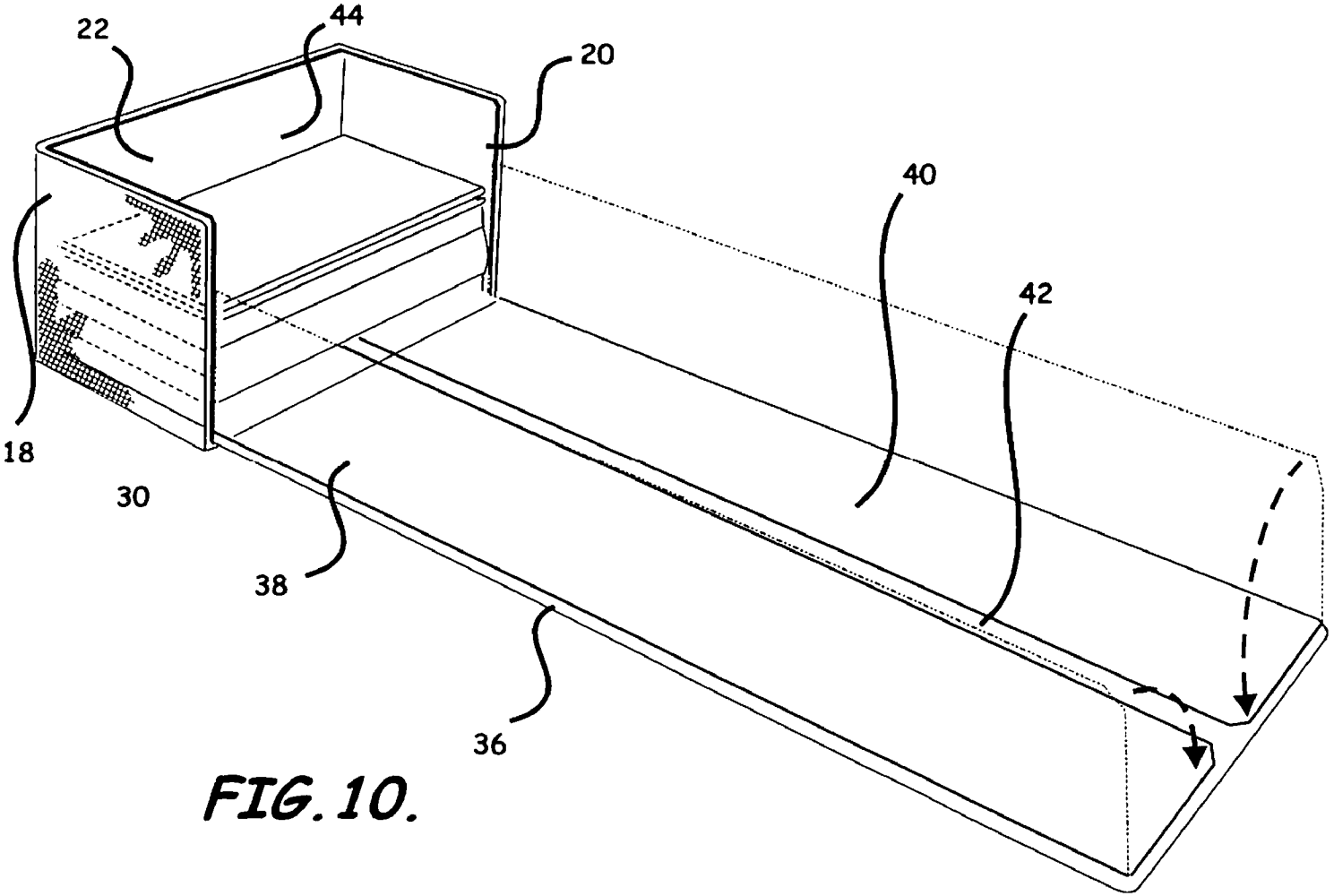
FIG. 10 shows that after detaching the first side wing from the first fixed sidewall of the shell, and the second side wing from the second fixed sidewall of the shell, the first side wing and the second side wing may be lowered so that they lie on top of the base.

One specific embodiment of the invention that comprises the same elements arranged in a slightly different manner to create a chair configuration 70. As illustrated in FIG. 10, the first side wing 38 is detached from the first fixed sidewall 18 of the shell 12, and the second side wing 40 from the second fixed sidewall 20, the first side wing 38 and the second side wing 40 may be lowered so that they lie on top of the base 36.

Figure 11:
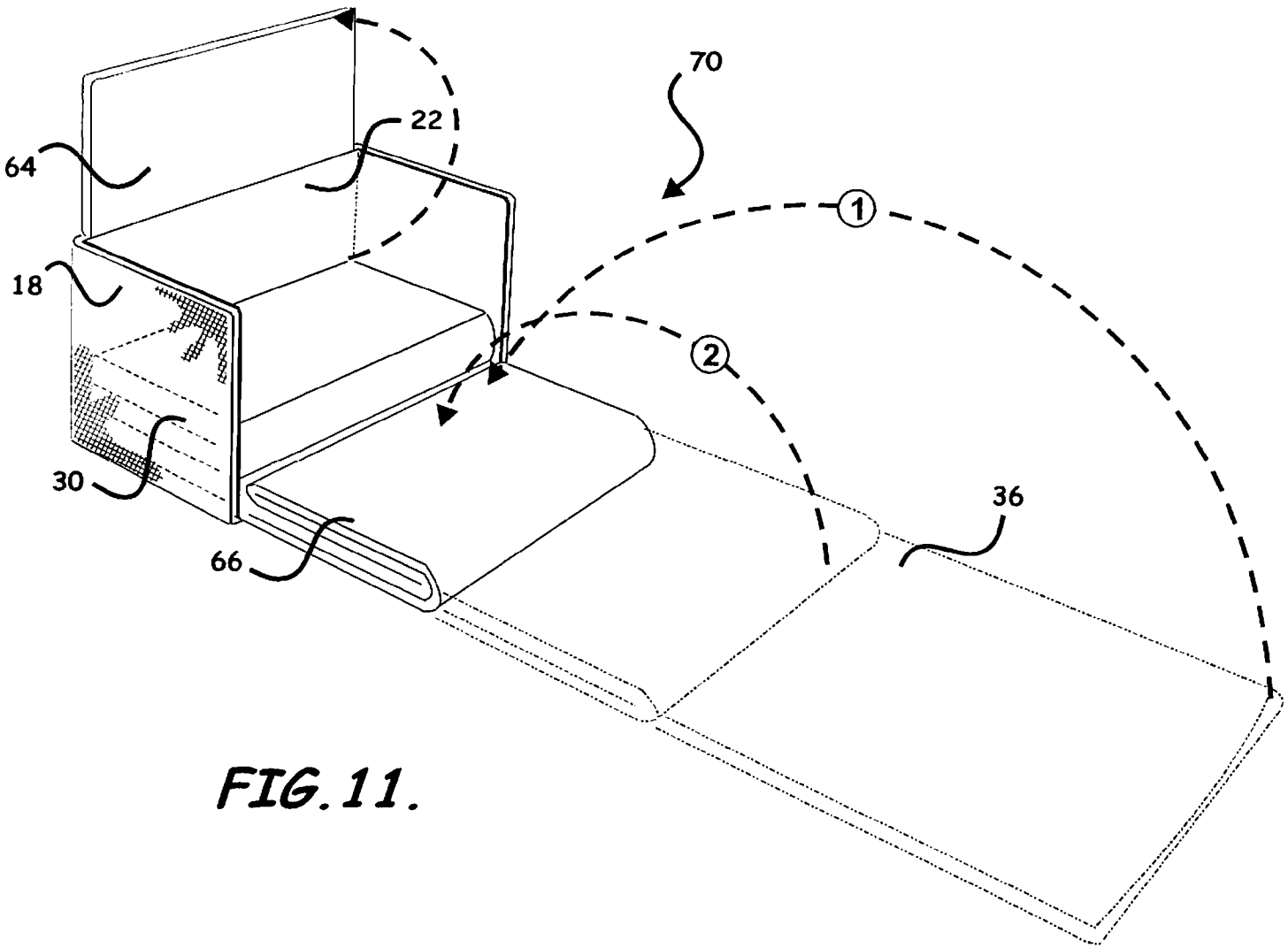
FIG. 11 shows that the awning may be lifted from the back of the shell and allowed to stand vertically to create a backrest, and the base may be first folded and then folded again to form a footrest.
Figure 12:
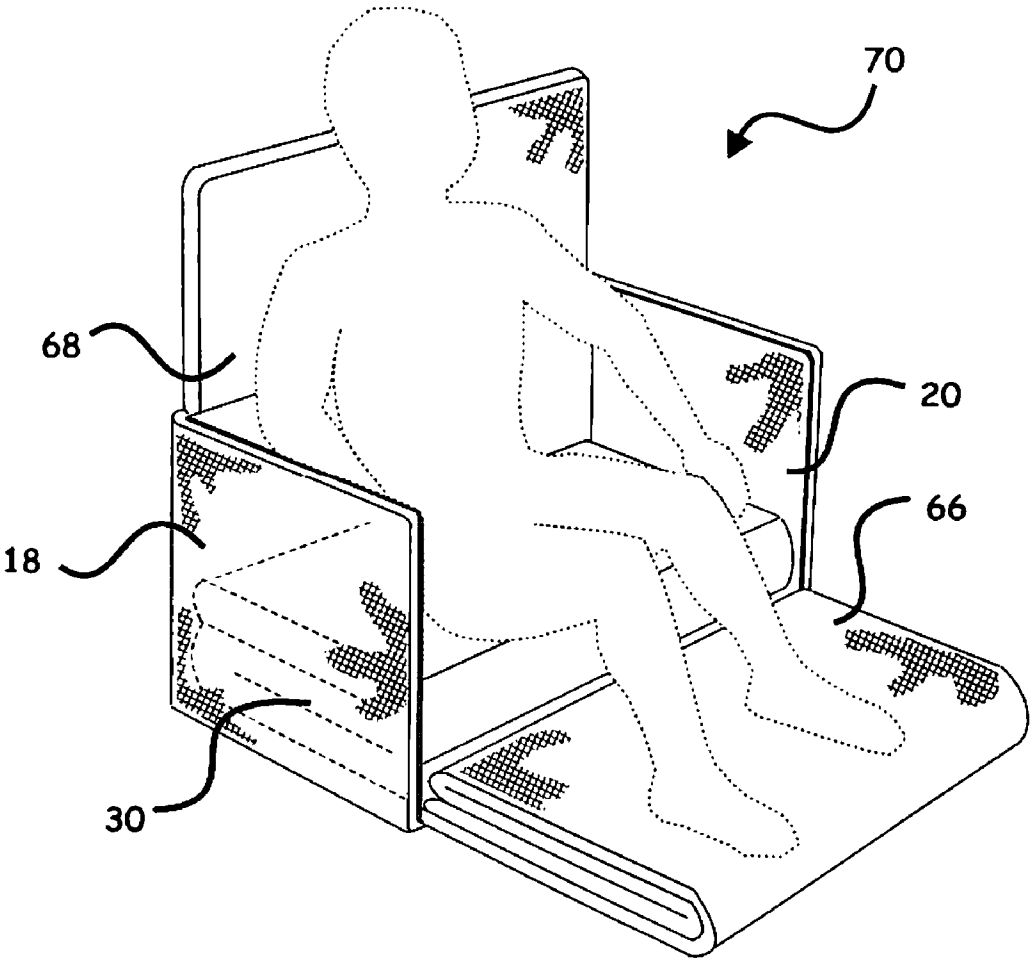
FIG. 12 illustrates the final chair configuration in use.

Starting from the stowed configuration 10, FIG. 11 shows that a top flap 64, which was previously referred to as an awning 24, is lifted from the back 22 of the shell and allowed to stand vertically to create a backrest 66. The base 36 is folded to a first extended position 37 and then folded again to form a footrest 66. FIG. 12 illustrates the final chair configuration 70 in use.

When neither the chair nor the bed is needed, the unit may be refolded into the stowed configuration as shown in FIG. 13. Starting from the chair configuration 70, the footrest is unfolded to the first extended position 37. The top flap 64 is then folded down on top of the plurality of cushions 30, and the optional blanket 32 and the optional pillow 34, if present. The base 36 is then folded over on top of the top flap 64 and is attached to the first sidewall 18 along the sidewall's front edge and top edge, to the back 22 along its top edge, and to the second sidewall 20 along its top edge and front edge. Although attachment will generally be by a zipper, the skilled will recognize that any suitable attachment means such as Velcro™ is possible.

In the specification there have been disclosed typical preferred embodiments of the invention, and although specific terms are employed, the terms are used in a descriptive sense only and not for purposes of limitation. The invention has been described in some detail, but it will be apparent that various modifications and changes can be made within the spirit and scope of the invention as described in the foregoing specification.

What is claimed is:

1. A furniture element convertible between a bed configuration and a stowed configuration comprising:

a shell having a bottom, two opposed sidewalls affixed to opposed side edges at of the bottom at their bottom edges, an open top, an open front, and a back wall affixed at opposite side edges to respective side edges of the sidewalls and at a bottom edge to a back edge of the bottom, and further having a top flap flexibly affixed at a back edge to a top edge of the back wall, and removably affixable at opposed side edges to corresponding top edges of the sidewalls to cover at least a portion of the open top; and a flexible base affixed to the shell bottom, the base having a pair of side wings each, flexibly affixed at a bottom edge to respective side edges of the base and removably affixable at rear edge to a respective sidewall for maintaining upward extension thereof, the base extendable forward of the shell and having an extended length at least as great as a sum of a height of the shell sidewalls and a width of the shell sidewalls;

wherein in the bed configuration the base extends forward of the shell, the side wings extend upwardly, each of the side wings rear edges affixed to the respective shell sidewalls, and the top flap side edges are affixed to the corresponding top edges of the sidewalls; and wherein in the stowed configuration the top flap is released from the sidewalls and is folded into an interior of the shell in opposition with the back wall, the side wings are released form the shell sidewalls and are folded onto the base, and the base is folded upward to cover the open top and front of the shell, at least a portion of the side edges of the base removably affixable to front and top edges of the shell sidewalls.

2. The furniture element convertible between a bed configuration and a stowed configuration of claim 1, further comprising an awning connected to the interior of back wall and attachably connected to the two opposed sidewalls.

3. The furniture element convertible between a bed configuration and a stowed configuration of claim 1, wherein in the bed configuration further comprising an awning removably connected to the back wall and connected to the two opposed sidewalls includes a mosquito netting connectable to the back wall, the two opposed sidewalls and the awning.

4. The furniture element convertible between a bed configuration and a stowed configuration of claim 1, further comprising a chair configuration the base extends forward of the shell, the side wings and top flap edges remain folded down allowing the base to be folded to form a footrest.

5. A portable furniture combination comprising:

a pair of side walls;

a back wall fixed at opposite side edges thereof to respective back edges of the side walls and arranged substantially perpendicular thereto;

a bottom wall fixed at opposite sides edges thereof to respective bottom edges of the pair of side walls and arranged substantially perpendicular to both the side walls and the back wall, such that the side walls, the back wall and the bottom wall constitute a four-sided shell having an open front side and top side;

a flexible base hingedly connected to the shell and foldable between a stowed base position, in which the base covers at least one of the open front and top sides of the shell, and an extended base position, in which the base extends forward of the bottom wall and lies substantially coplanar therewith; and a pair of flexible wings hingedly connected to opposite sides edges of the base and releasably connected to respective front edges of the side walls, the wings being foldable between a stowed wing panel position, in which the wings overlie the base, are further foldable therewith and are detached from the side walls, and an extended wing position, in which the wings stand approximately perpendicular to the base and are connected to the side walls.

6. The portable furniture combination of claim 5, wherein, in the stowed base position, the base covers both the open front and top sides of the shell and is releasably connected thereto to form a substantially enclosed box.

7. The portable furniture combination of claim 5, wherein, a plurality of serially-connected cushions, a first end of the plurality of cushions being connected to the shell and the plurality of cushions being foldable between a stowed cushion position, in which the cushions are completely accommodated within the shell, and an extended cushion position, in which the cushions extend between the wings and overlie the base.

* * * * *